United States Patent [19]

Mitchell

[11] Patent Number: 4,538,393

[45] Date of Patent: Sep. 3, 1985

[54] FOLDING TRUSS

[75] Inventor: Terry L. Mitchell, Grand Rapids, Mich.

[73] Assignee: Jer Manufacturing, Inc., Coopersville, Mich.

[21] Appl. No.: 444,531

[22] Filed: Nov. 26, 1982

[51] Int. Cl.[3] ..... E04B 1/344

[52] U.S. Cl. ..... 52/641; 16/371; 16/366; 52/92; 52/645; 403/113

[58] Field of Search ..... 52/641, 645, 105, 92; 16/366, 371, 321, 333, 335; 403/113

[56] References Cited

U.S. PATENT DOCUMENTS

| | | | |
|---|---|---|---|
| 506,154 | 10/1893 | Buhrman | 16/371 |
| 1,232,168 | 7/1917 | Aronson . | |
| 1,387,698 | 8/1921 | Erickson | 52/92 |
| 1,505,593 | 8/1924 | Fryer | 16/366 |
| 1,520,134 | 12/1924 | Mizer . | |
| 1,861,613 | 6/1932 | Sadenwater | 403/113 |
| 1,966,599 | 7/1934 | Roualet | 403/113 |
| 2,642,825 | 6/1953 | McElhone et al. | 108/23 |
| 2,849,757 | 9/1958 | Meldrum | 52/105 X |
| 3,423,898 | 1/1969 | Tracy et al. | 52/713 |
| 3,426,495 | 2/1969 | Glasgow | 52/641 |
| 3,605,355 | 4/1969 | Solesbee | 52/90 |
| 3,638,373 | 2/1972 | Chapman | 52/92 |
| 3,727,354 | 4/1973 | Powell | 52/71 |
| 3,736,708 | 6/1973 | Chapman | 52/92 |
| 3,760,550 | 9/1973 | Mueller et al. | 52/641 |
| 4,073,455 | 2/1978 | Gunther | 248/291 |
| 4,167,090 | 9/1979 | Sanford | 52/641 |
| 4,189,247 | 2/1980 | Burwall | 403/4 |
| 4,261,596 | 4/1981 | Douglas | 280/652 |

FOREIGN PATENT DOCUMENTS

| | | | |
|---|---|---|---|
| 728700 | 12/1942 | Fed. Rep. of Germany | 52/645 |
| 2367155 | 6/1978 | France | 52/641 |
| 355993 | 8/1931 | United Kingdom | 16/371 |

*Primary Examiner*—Alfred C. Perham

*Attorney, Agent, or Firm*—Price, Heneveld, Huizenga & Cooper

[57] ABSTRACT

The specification discloses a structural connector for pivotally connecting two support members to form a folding truss. The support members can be pivoted with respect to the connector between collapsed and extended positions. The connector includes a generally planar body, a locator tab extending from the body and secured between the support members when in their extended position to orient the connector with respect to the connector, and spring clips extending from the body to lock the support members in their extended position. In an alternative embodiment, the connector includes two of the locator tabs to maintain the support members in spaced relation so that a ridge member can be positioned therebetween.

4 Claims, 6 Drawing Figures

FOLDING TRUSS

BACKGROUND OF THE INVENTION

The present invention relates to kit buildings and more particularly to a folding truss utilized in erecting kit buildings.

Kit buildings have gained widespread popularity due to their low-cost provision of storage space. The most common and well-known kit building is the relatively small barn-shaped utility shed, which a consumer purchases and erects to store his lawn mower, gardening tools, and other lawn and garden implements and chemicals. A kit building is generally purchased in its collapsed, or unassembled, form wherein the entire unassembled kit requires a relatively small space for transportation and storage. Although collapsed, many of the elements of the kit are preferably interconnected to faciliate subsequent assembly by the consumer. The kits typically contain one or more folding trusses, each comprising two rafters pivotally interconnected by a structural connector. Such a truss can be compactly folded for transportation and subsequently easily set up by the consumer. The commercial success of a kit building depends in part on the ease with which the kit can be erected by the average consumer.

Known structural connectors for folding trusses are not without their disadvantages. One such connector is stamped, or cut, from a single sheet of metal and then carefully folded into a complex connector, including a ridge support member and two pockets hingedly connected thereto each for receiving a rafter. An example of such a connector is shown in U.S. Pat. No. 3,423,898, entitled ROOF FRAMING SYSTEM and issued Jan. 28, 1969, to Tracy et al. However, the connector is relatively expensive because of the relatively large amount of material required to form the connector and the excessive labor required to fold the material to form the connector. Consequently, the connector unduly increases the cost of the kit building.

Another connector includes a single sheet of material which is rigidly secured to one support member and pivotally secured to a second support member such that the first and second support members may be pivoted with respect to one another. An example of such a connector is shown in U.S. Pat. No. 3,605,355, entitled ROOF STRUCTURE and issued Sept. 20, 1971, to Solesbee. However, this connector requires excessive labor in the fabrication of the building kit due to the fact that a plurality of fasteners must be used to fixedly secure the connector to the nonpivotally joined rafter. If a plurality of fasteners is not used to join the connector to at least one support member, the connector can shift with respect to both support members to assume an undesired position, for example, protruding above the roof line or below the joist.

Yet another connector includes two separate pieces pivotally interconnected, each of which in turn receives a support member. An example of this type of connector may be seen in U.S. Pat. No. 4,189,247, entitled STRUCTURAL CONNECTOR and issued Feb. 19, 1980, to Burwall. However, this two-piece connector is relatively expensive to fabricate because two pieces must be stamped and pivotally interconnected. This increases the cost of the resultant building kit.

SUMMARY OF THE INVENTION

The aforementioned problems are solved by the present invention comprising a one-piece, generally planar structural connector for a folding truss, which may be pivotally secured to two rafters each by a single pivotal connector. More specifically, the connector comprises a generally planar body which defines two apertures for receiving pivotal connectors each of which extends into a rafter, and a locator tab integral with and extending generally perpendicularly from the body to abut at least one of the rafters to properly orient the connector with respect to the unfolded rafters. The present connector can be easily and inexpensively fabricated from a single sheet of material. Additionally, the connector orients itself into a desired position during unfolding of the truss by means of the locator tab operating in conjunction with the rafter members.

In a preferred embodiment, the connector additionally comprises detent means for locking the rafters in the extended position. Accordingly, the truss once extended cannot accidentally collapse while the truss is being maneuvered into position on top of the partially erected kit building. This safety feature greatly reduces potential injury to consumers during building erection. Even more preferably, the detent means are integrally formed with the generally planar body to simplify construction and reduce cost.

These and other objects, advantages, and features of the invention will be more readily understood and appreciated by reference to the written specification and appended drawings.

DESCRIPTION OF THE PREFERRED EMBODIMENT

Figure 1:
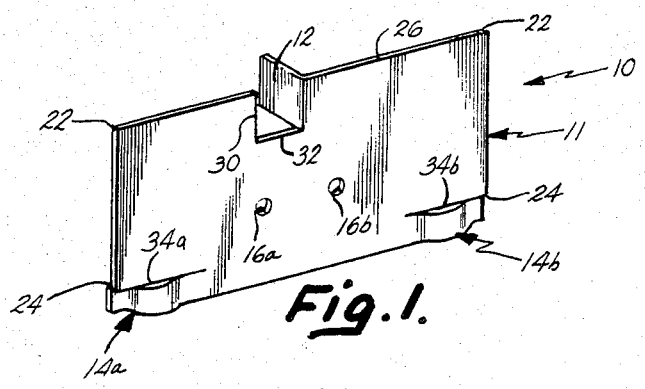
FIG. 1 is a perspective view of a structural connector constructed in accordance with a preferred embodiment of the present invention.
Figure 2:
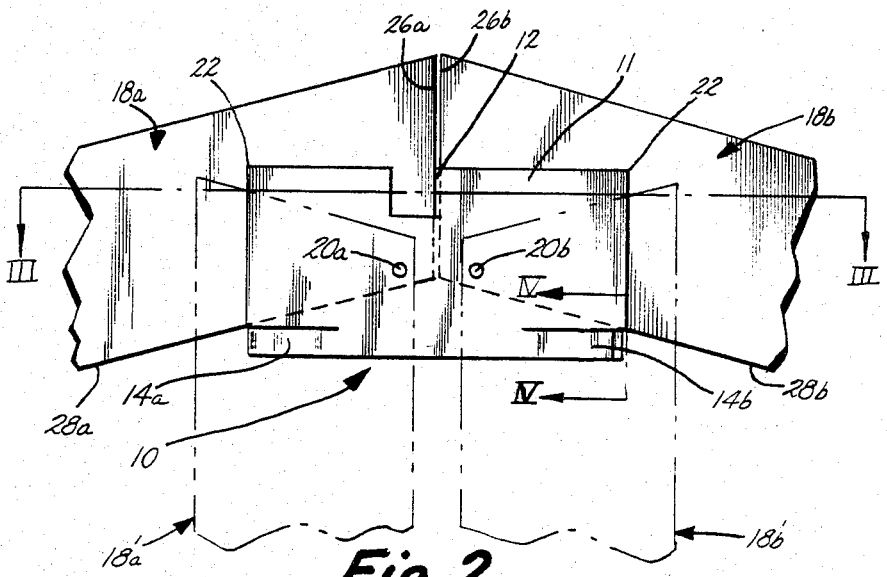
FIG. 2 is a front elevational view of the connector joining two rafters shown in the extended position with the collapsed position shown in phantom.
Figure 3:
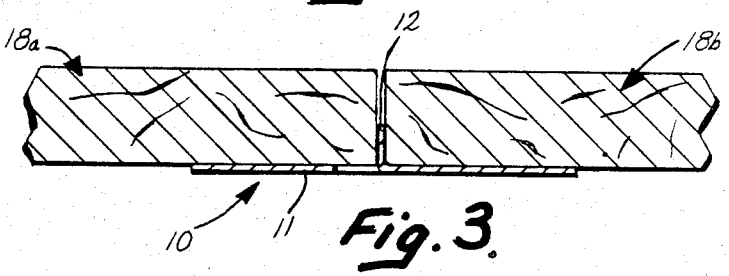
FIG. 3 is a sectional view taken along plane III—III in FIG. 2.
Figure 4:
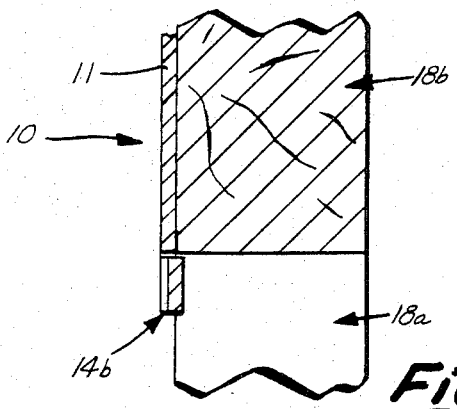
FIG. 4 is a sectional view taken along plane IV—IV in FIG. 2.

A structural connector constructed in accordance with a preferred embodiment of the invention is illustrated in FIGS. 1–4 and generally designated 10. As most clearly seen in FIG. 1, connector 10 comprises generally planar body 11 from which are bent locator tab 12 and a pair of spring clips 14*a* and 14*b*. Additionally, a pair of apertures 16*a* and 16*b* are defined in the central portion of body 11 to receive pivotal connectors 20*a* and 20*b*, for examples nails, extending into rafters 18*a* and 18*b*. Rafters 18 may be pivoted between their extended, or support, position illustrated in FIG. 2 and a collapsed, or storage, position illustrated in phantom in FIG. 2. Typically, the truss is shipped for storage in its collapsed position as shown in phantom in FIG. 2. During building erection, rafters 18*a* and 18*b* are pivoted to their extended position as shown in FIG. 2 with locator tab 12 entrapped between the two rafters. Locator tab 12 insures that connector 10 will be properly oriented with respect to rafters 18. When rafters 18 are fully extended, spring clips 14 snap outwardly from body 11 and underneath rafters 18 to secure the rafters in the extended position so that the truss may be safely positioned on the partially erected building.

Turning more specifically to the construction of connector 10, body 11 is generally rectangular including a pair of upper corners 22 and a pair of lower corners 24 at which spring clips 14 are located. Upper edge 26 of connector 10 extends between corners 22. Locator tab 12 is located approximately midway between corners 22 and extends generally perpendicularly from body 11. When rafters 18 are in their extended positions, locator tab 12 is secured between, and abuts both of, the rafters as most clearly illustrated in FIGS. 2 and 3. Spring clips 14*a* and 14*b* are located at lower corners 24 of body 11 and extend slightly rearwardly therefrom in a direction generally common with locator tab 12. Apertures 16*a* and 16*b* are defined by body 11 mediate spring clips 14 and locator tab 12.

Rafters 18 are typically fabricated of wood and include beveled ends 26*a* and 26*b*, respectively, which abut to define the angle between the extended rafters. Each of rafters 18 includes an undersurface 28 beneath which spring clips 14 lock.

Fabrication and Operation

Connector 10 is fabricated by one operation of a press or by sequentially first stamping or cutting a rectangular body 11 from a sheet of stock material. In the preferred embodiment, the material used is a relatively lightweight gauge galvanized steel. Locator tab 12, spring clips 14, and apertures 16 are then formed in any desired order. Locator tab 12 is formed by making cuts along lines 30 and 32 (FIG. 1) and then bending locator tab 12 defined by lines 30 and 32 outwardly from body 11 to be generally perpendicular thereto. Apertures 16*a* and 16*b* can be formed by punching, drilling, or stamping. Spring clips 14 are formed by first cutting along lines 34*a* and 34*b* (FIG. 1) and then bending the cut portions rearwardly from body 11 in a direction generally common with locator tab 12 to form the spring clips.

The folding truss is fabricated by securing a connector 10 to rafters 18*a* and 18*b*. Nails 20*a* and 20*b*, or other suitable pivotal fasteners, are driven through apertures 16 and into rafters 18. During storage and/or transportation, rafters 18 are folded to their collapsed position 18' as indicated in phantom in FIG. 2.

During building erection, rafters 18 are moved to their extended, or support, position as shown in FIG. 2. Rafters 18*a* and 18*b* are grasped and moved outwardly from one another until beveled ends 26*a* and 26*b* abut one another. Because locator tab 12 extends rearwardly from body 11 of connector 10, the tab is secured between rafter ends 26 during unfolding of the truss. Tab 12 insures that connector 10 is oriented into its desired position with respect to deployed rafters 18 because tab 12 can assume only one position when the rafters are extended, i.e., directly between ends 26*a* and 26*b*. As rafters 18 are unfolded, spring clips 14 bear against the rafters. When the rafters are fully deployed, spring clips 14*a* and 14*b* spring outwardly from body 11 and beneath undersurfaces 28*a* and 28*b*, respectively, to lock the rafters in the deployed position. The unfolded truss may then be secured in position on the partially erected building without fear of the truss collapsing.

Alternative Embodiment

Figure 5:
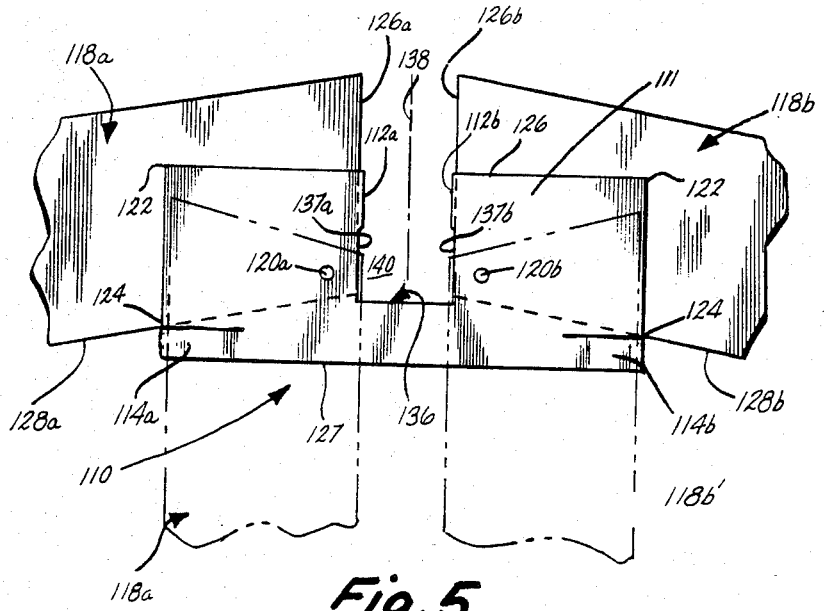
FIG. 5 is a front elevational view similar to FIG. 2 showing an alternative embodiment of the structural connector.
Figure 6:
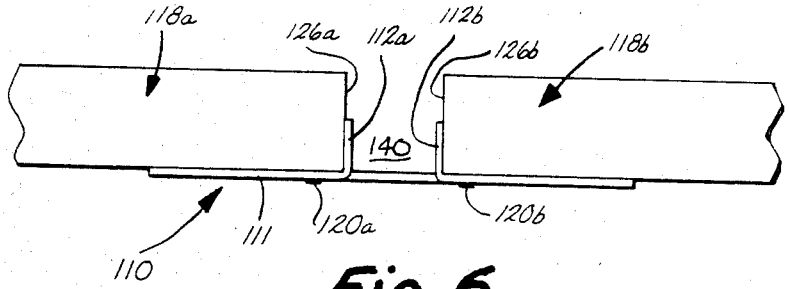
FIG. 6 is a top plan view of the structural connector and rafters shown in FIG. 5.

An alternative embodiment 110 of the connector is illustrated in FIGS. 5 and 6. Generally speaking, connector 110 is identical to connector 10 with the exception of U-shaped cutout 136 and the inclusion of two locator tabs 112*a* and 112*b*. Elements of connector 110 which are identical to elements of connector 10 bear the identical numerical designation preceded by a 1 (i.e., 112 and 12). Cutout 136 extends into body 111 through upper edge 126 and terminates short of opposite edge 127. The width of cutout 136 is selected to receive a ridge support of a generally similar width. Tabs 112*a* and 112*b* extend generally perpendicularly from body 111 from either side 137*a* and 137*b*, respectively, of the cutout.

The only difference in fabricating connector 110 from fabricating connector 10 is the formation of cutout 136 and locator tabs 112. To form cutout 136, body 111 is first cut along center line 138 from upper edge 126 to the bottom of cutout 136. Locator tabs 112*a* and 112*b* are then bent outwardly from body 111 and any excess material is trimmed and discarded to complete formation of cutout 136.

The folding truss utilizing connector 110 is assembled as the folding truss using connector 10. However, when the truss including connector 110 is unfolded, locator tabs 112*a* and 112*b* maintain rafter ends 126*a* and 126*b*, respectively, in spaced relation (FIG. 5) to define a void 140 into which a ridge support (not shown) can be positioned. As with connector 10, spring clips 114 lock behind undersurfaces 128*a* and 128*b* to lock the rafters in their deployed position.

It should be understood that the above descriptions are intended to be those of preferred embodiements of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. An improved folding truss including a connector and first and second support members each pivotally connected to the connector whereby the support members can be pivoted between collapsed and extended positions, wherein the improvement comprises the connector comprising:

a body having a generally planar portion to which said first and second support members are pivotally connected;

a locator member extending generally perpendicularly from said body to abut at least one of said first and second support members when said support members are in their extended position for orienting said connector into a desired relation with respect to said one support member; and detent means supported by said body for locking said first and second support members in their extended position, said locator member and said detent means cooperating to maintain said first and second support members in fixed relation to said connector.

2. An improved folding truss as defined in claim 1 wherein said locator member comprises a tab integral with said body and bent outwardly therefrom.

3. An improved folding truss as defined in claim 1 wherein said locator member is positioned directly between said support members when in the extended position.

4. An improved folding truss as defined in claim 1 wherein said detent means are integral with said body and are bent outwardly from said body in a direction common with said locator member.

* * * * *